US007771162B2

(12) United States Patent
Castan

(10) Patent No.: US 7,771,162 B2
(45) Date of Patent: Aug. 10, 2010

(54) CAMBERED VANE FOR USE IN TURBOCHARGERS

(75) Inventor: Joel P. Castan, Epinal (FR)

(73) Assignee: Honeywell International Inc., Morristown, NJ (US)

( * ) Notice: Subject to any disclaimer, the term of this patent is extended or adjusted under 35 U.S.C. 154(b) by 865 days.

(21) Appl. No.: 10/584,823

(22) PCT Filed: Dec. 31, 2003

(86) PCT No.: PCT/EP03/15034

§ 371 (c)(1),
(2), (4) Date: Jun. 26, 2006

(87) PCT Pub. No.: WO2005/064121

PCT Pub. Date: Jul. 14, 2005

(65) Prior Publication Data

US 2007/0107426 A1 May 17, 2007

(51) Int. Cl.
*F04D 29/46* (2006.01)

(52) U.S. Cl. ..... 415/164; 415/208.2

(58) Field of Classification Search ..... 415/164, 415/165, 186, 208.2
See application file for complete search history.

(56) References Cited

U.S. PATENT DOCUMENTS 6,709,232 B1 * 3/2004 Vogiatzis ..... 415/163
2003/0079474 A1 * 5/2003 Finger et al. ..... 60/602

* cited by examiner

*Primary Examiner*—Edward Look
*Assistant Examiner*—Dwayne J White

(57) ABSTRACT

Various cambered vanes are constructed for use within a vaned turbocharger and include an inner airfoil surface oriented adjacent a turbine wheel, and an outer airfoil surface oriented opposite the inner airfoil surface. The inner and outer airfoil surfaces define a vane airfoil thickness. A cambered vane leading edge or nose is positioned along a first inner and outer airfoil surface junction, and a vane trailing edge positioned along a second inner and outer surface junction. The vane inner and outer airfoil surfaces are specially configured to provide a vane camberline having a curved section, which can. provide for improved gas flow distribution, thereby increasing the effective operating range of the turbocharger.

11 Claims, 6 Drawing Sheets

CAMBERED VANE FOR USE IN TURBOCHARGERS

FIELD OF INVENTION

This invention relates generally to the field of turbochargers and, more particularly, to variable geometry turbochargers using movable vanes that are specially shaped for the purpose of widening the operating window and maximizing flow efficiency within the turbocharger.

BACKGROUND OF THE INVENTION

Turbochargers for gasoline and diesel internal combustion engines are devices known in the art that are used for pressurizing or boosting the intake air stream, routed to a combustion chamber of the engine, by using the heat and volumetric flow of exhaust gas exiting the engine. Specifically, the exhaust gas exiting the engine is routed into a turbine housing of a turbocharger in a manner that causes an exhaust gas-driven turbine to spin within the housing. The exhaust gas-driven turbine is mounted onto one end of a shaft that is common to a radial air compressor mounted onto an opposite end of the shaft and housed in a compressor housing. Thus, rotary action of the turbine also causes the air compressor to spin within a compressor housing of the turbocharger that is separate from the turbine housing. The spinning action of the air compressor causes intake air to enter the compressor housing and be pressurized or boosted a desired amount before it is mixed with fuel and combusted within the engine combustion chamber.

In a turbocharger it is often desirable to control the flow of exhaust gas to the turbine to improve the efficiency or operational range of the turbocharger. Variable geometry turbochargers (VGTs) have been configured to address this need. A type of such VGT is one having a variable or adjustable exhaust nozzle, referred to as a variable nozzle turbocharger. Different configurations of variable nozzles have been employed in variable nozzle turbochargers to control the exhaust gas flow. One approach taken to achieve exhaust gas flow control in such VGTs involves the use of multiple vanes, which can be fixed, pivoting and/or sliding, positioned annularly around the turbine inlet. The vanes are commonly controlled to alter the throat area of the passages between the vanes, thereby functioning to control the exhaust gas flow into the turbine.

Conventional vanes used with VGTs are shaped having a straight vane profile that is designed to provide an airfoil shape that is configured to both provide a complementary fit with adjacent vanes when placed in a closed position, and to provide for the passage of exhaust gas within the turbine housing to the turbine wheel when placed in an open position. Thus, the use of such straight vanes function to control a throat area of turbine housing, thereby operating to control the boost delivered by the turbocharger. However, such straight vanes are only able to provide a well-distributed flow of exhaust gas to the turbine wheel within a small range of the total use, thereby not contributing to the most efficient turbocharger operation.

It is, therefore, desired that the vanes used with a variable geometry turbochargers be specially configured in a manner that broadens the desired gas flow distribution window, thereby operating to facilitate and promote efficient turbocharger operation. It is also desired that such vanes be designed in a manner that facilities use of the same within variable geometry turbochargers with minimum adjustments or retrofit changes.

SUMMARY OF THE INVENTION

Cambered vanes of this invention are constructed for use within vaned turbochargers, including but not limited to a VGT. The VGT comprises a turbine housing having an exhaust gas inlet and an outlet, a volute connected to the inlet, and a nozzle wall adjacent the volute. A turbine wheel is carried within the turbine housing and is attached to a shaft. A number of such cambered vanes are disposed within the turbine housing between the exhaust gas inlet and turbine wheel.

Each cambered vane comprises an inner airfoil surface oriented adjacent the turbine wheel, and an outer airfoil surface oriented opposite the inner airfoil surface. The inner and outer airfoil surfaces define a vane airfoil thickness. A cambered vane leading edge or nose is positioned along a first inner and outer airfoil surface junction, and a vane trailing edge positioned along a second inner and outer surface junction.

The vane inner and outer airfoil surfaces are specially configured to provide a vane camberline, positioned between the airfoil surfaces and extending along a length of the vane, that is curved along a substantial length of the camberline. The camberline curve section has a measure of curvature that is defined within a degree of tolerance by a vane placement diameter as measured between diametrically opposed vanes. In an example embodiment, the camberline curve has a measure of curvature within 75 to 125 percent of the vane placement diameter.

Vanes configured in this manner provide improved gas flow distribution within the turbine housing, thereby operating to increasing the effective operating range of the turbocharger.

BRIEF DESCRIPTION OF THE DRAWINGS

The invention will be more clearly understood with reference to the following drawings wherein.

DETAILED DESCRIPTION OF THE INVENTION

The invention, constructed in accordance with the principles of this invention, comprises a cambered vane for use in a vaned turbocharger, including but not limited to a variable geometry turbocharger (VGT). For convenience, an exemplary embodiment using a VGT will be described throughout this specification. However, it will be readily understood by those skilled in the relevant technical field that the improved vane of the present invention could be used in a variety of turbocharger configurations, including fixed vane turbochargers and those of the sliding and/or pivoting vane type.

Generally speaking, the vane is configured having a cambered airfoil profile for purposes of broadening the desired gas flow distribution window within the turbocharger, thereby operating to minimize any unwanted aerodynamic effects within a turbine housing and improve turbocharger operating efficiency when compared to conventional turbocharger vane designs.

Figure 1:
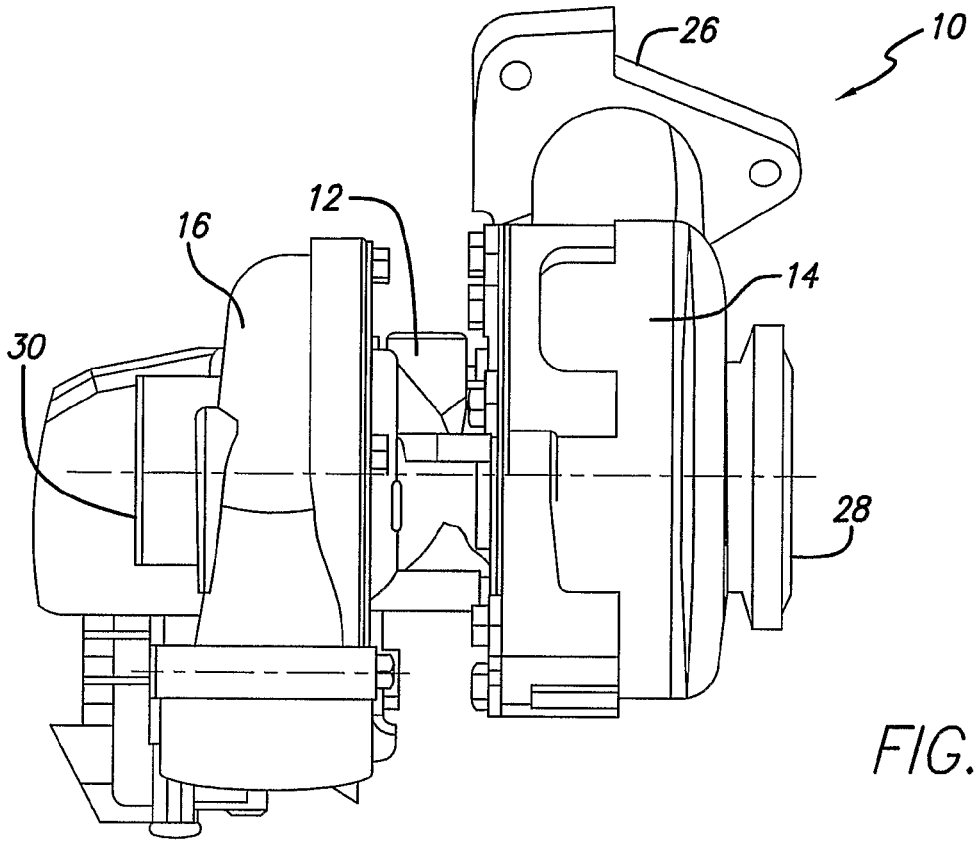
FIG. 1 is an elevational side view of a variable geometry turbocharger comprising a number of pivoting vanes of this invention.
Figure 2:
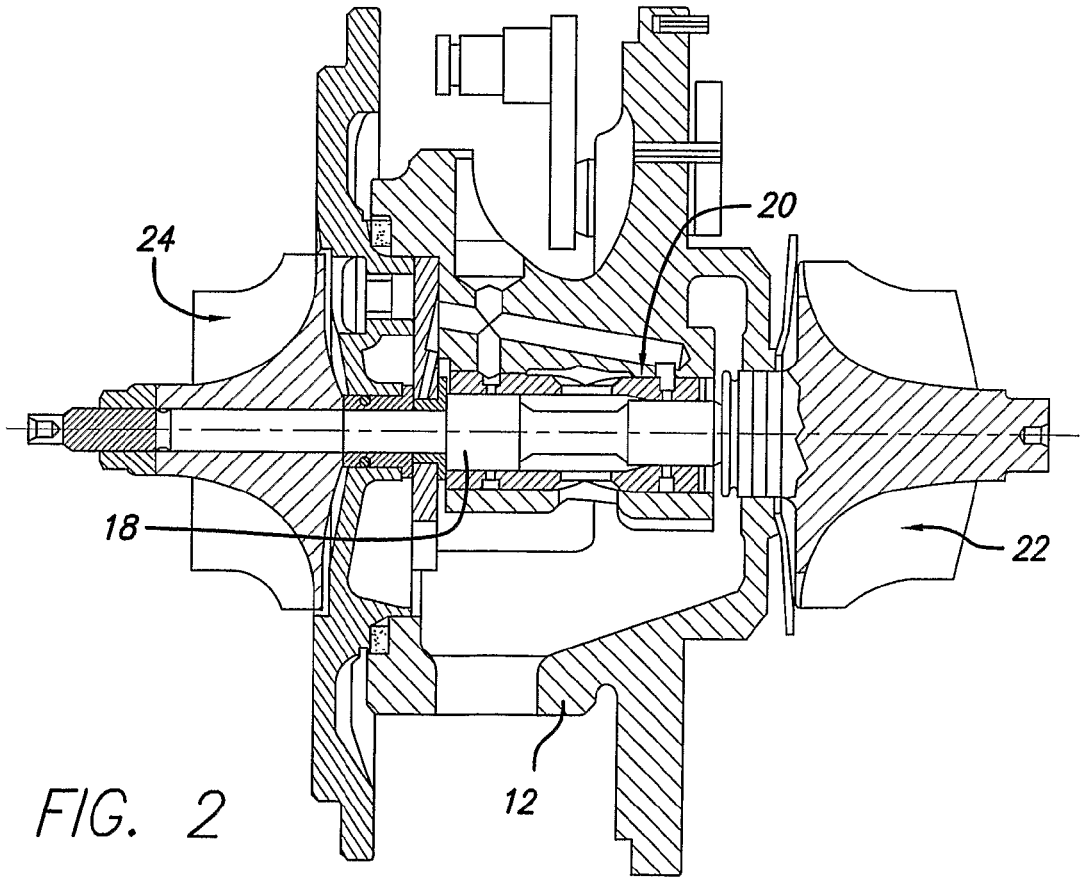
FIG. 2 is a cross-sectional side elevation of the variable geometry turbocharger of FIG. 1.

Referring to FIG. 1, a turbocharger 10 generally comprises a center housing 12 having a turbine housing 14 attached at one end, and a compressor housing 16 attached at an opposite end. Referring to FIG. 2, a shaft 18 is rotatably disposed within a bearing assembly 20 contained within the center housing 12. A turbine or turbine wheel 22 is attached to one shaft end and is disposed within the turbine housing, and a compressor impeller 24 is attached to an opposite shaft end and is disposed within the compressor housing. The turbine and compressor housings are attached to the center housing by, for example, bolts that extend between the adjacent housings.

Referring back to FIG. 1, the turbine housing is configured having an exhaust gas inlet 26 that is configured to direct exhaust gas radially to the turbine wheel, and an exhaust gas outlet 28 that is configured to direct exhaust gas axially away from the turbine wheel and the turbine housing. A volute (not shown) is connected to the exhaust inlet and an outer nozzle wall is incorporated in the turbine housing adjacent the volute. Exhaust gas, or other high-energy gas supplying the turbocharger, enters the turbine housing through the inlet 26 and is distributed through the volute in the turbine housing for substantially radial delivery to the turbine wheel through a circumferential nozzle entry. The compressor housing 16 includes an air inlet 30, for directing air axially to the compressor impeller, and an air outlet (not shown), for directing pressurized air radially out of the compressor housing and to an engine intake system for subsequent combustion.

Figure 3A:
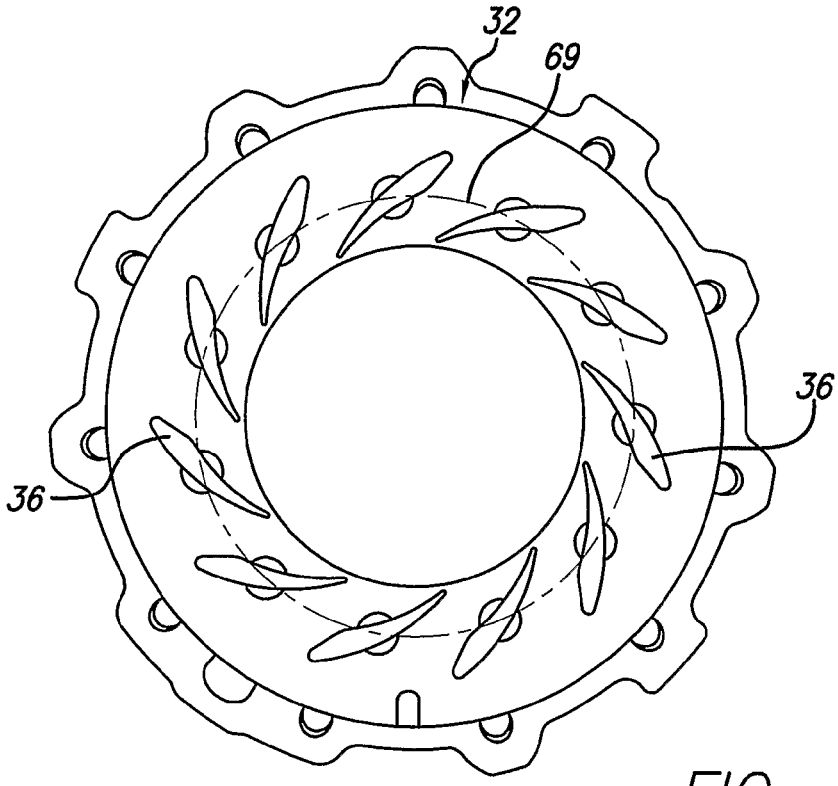
FIGS. 3A to 3C are top plan views of opposite surfaces of a nozzle ring that is disposed within a turbine housing of the variable geometry turbocharger of FIG. 1.

FIG. 3A illustrates a front side surface of a nozzle and unison ring assembly 32 that is disposed within the turbine housing, radially around the turbine wheel. Generally speaking, the nozzle and unison ring assembly operate to control the flow of exhaust gas entering the turbine housing to the turbine wheel, thereby regulating turbocharger operation. The assembly 32 comprises a nozzle ring 34 that is positioned, for example, adjacent a nozzle wall of the turbine housing, and that is positioned concentrically around the turbine wheel. A number of movable, e.g., pivotable, vanes 36 are movably attached to the nozzle ring 34. The vanes 36 are positioned around the turbine wheel and operate to control exhaust gas flow to the turbine wheel. A unison ring (see 38 in FIG. 3B) is movably coupled on an opposite surface of the nozzle ring 34 to the multiple vanes 36 to effect vane movement in unison.

Figure 3B:
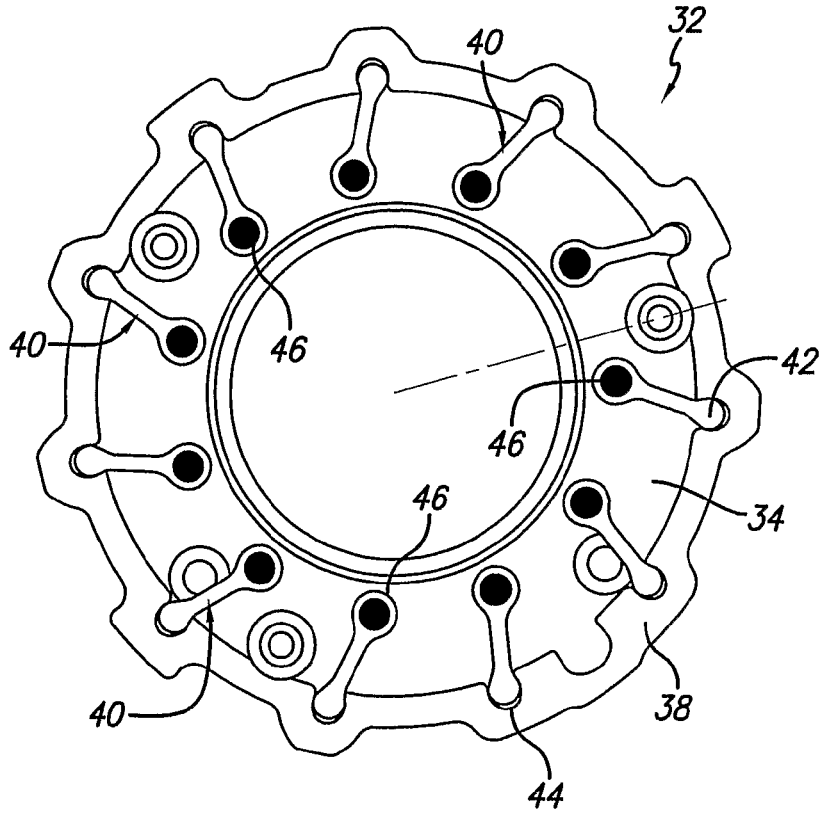
Figure 3C:
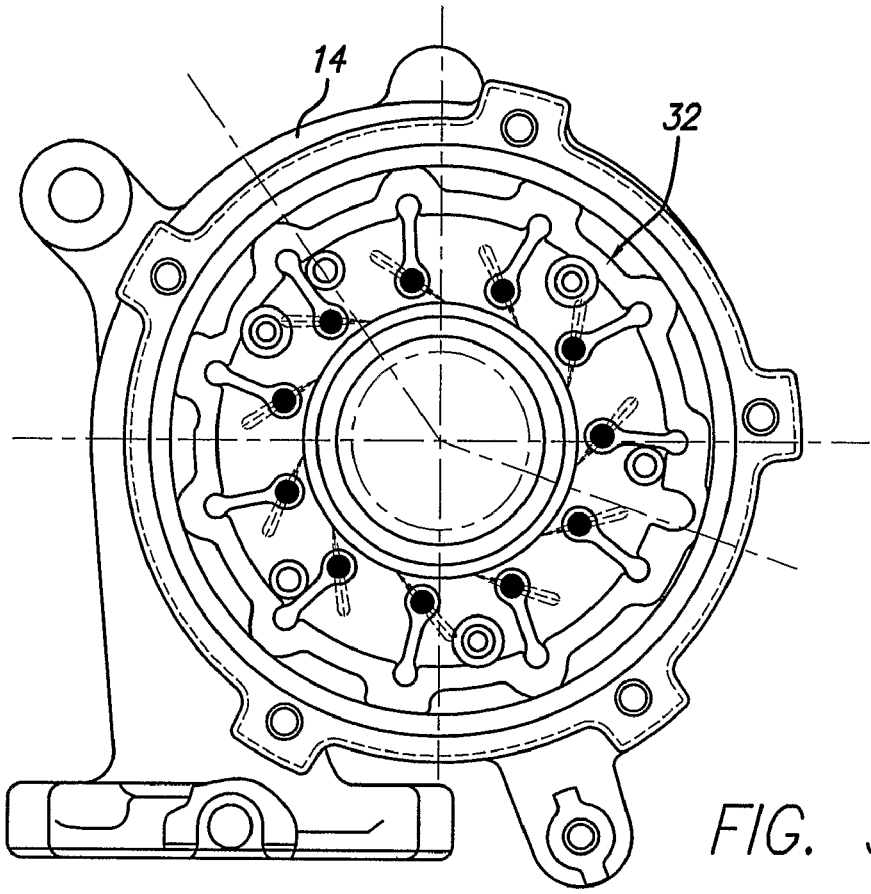

FIG. 3B illustrates an opposite surface of the nozzle and unison ring assembly 32, again showing the nozzle ring 34 and unison ring 38 that is disposed therearound. A number of arms 40 are interposed between/adjacent to the nozzle ring 34 and the unison ring 38 for the purpose of connecting the unison ring to the vanes. Each arm 40 includes an outer end 42 that is designed to movably fit within a respective complementary space or slot 44 disposed within the unison ring, and an inner end 46 that is designed to attach with a respective vane. FIG. 3C illustrates the same view of the nozzle and unison ring assembly 32 as FIG. 3B, this time as positioned within the VGT turbine housing 14.

Configured in this manner, the unison ring is to rotate within the turbine housing relative to the fixed nozzle ring, which rotation operates to move the arms 40 relative to the nozzle ring, thereby moving the vanes. An actuator assembly (not shown) is connected to the unison ring 38 and is configured to rotate the unison ring in one direction or the other as necessary to move the vanes radially outwardly or inwardly to control the pressure and/or volumetric flow of the exhaust gas that is directed to the turbine.

Figure 4A:
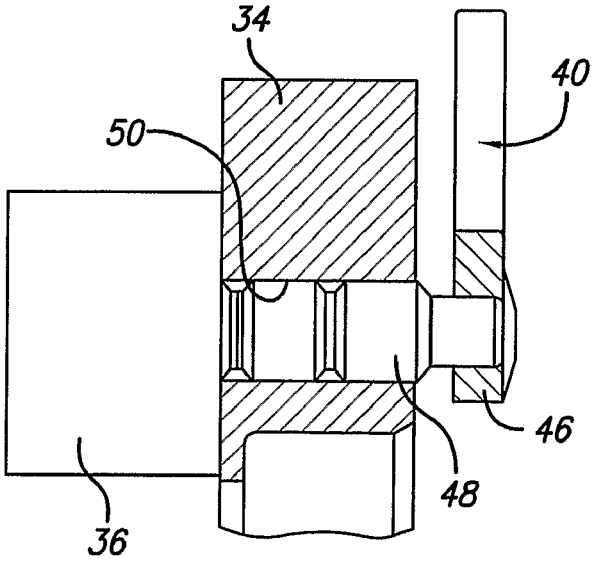
FIGS. 4A and 4B are respective side cross-sectional and top plan views illustrating placement of pivoting vanes with the nozzle ring of FIGS. 3A and 3B.
Figure 4B:
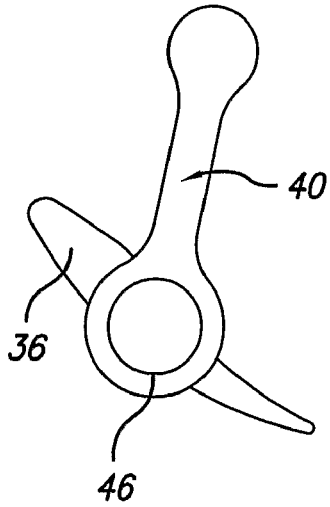

FIGS. 4A and 4B illustrate how the arms 40 and respective vanes 36 cooperate with one another through the nozzle ring 34. Each vane 36 is movably attached to the nozzle ring by, e.g., a pin 48 that is attached at one of its ends to an axial surface of the vane, and that is attached at an opposite end to end 46 of the arm 40. The pin projects through an opening 50 in the nozzle ring, and the vane and arm are fixedly attached to each respective pin end. Configured in this manner, rotational movement of each arm, on one surface of the nozzle ring, effects a pivoting movement of the vane, on the opposite surface of the nozzle ring.

Figure 5A:
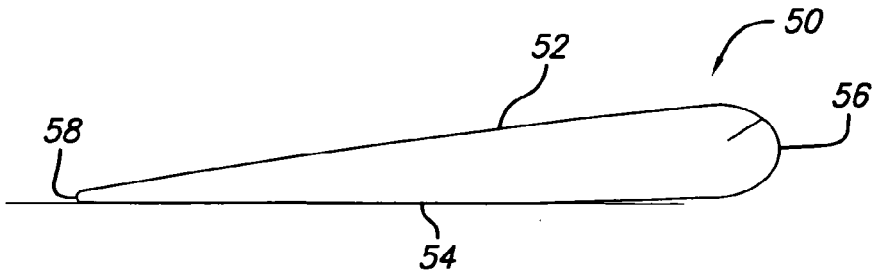
FIG. 5A PRIOR ART
FIGS. 5A and 5B are a respective elevational side view of a first prior art vane design as used with a variable geometry turbocharger, and a camberline graph for the same.

FIG. 5A illustrates a conventional "straight" vane 50 known to be used with VGTs as described above. This particular vane is characterized by having an inner airfoil surface 52 and an outer airfoil surface 54 that are each flat or planar in design. Each inner and outer air foil surface extends from a vane leading edge or nose 56 having a first radius of curvature, to a vane trailing edge or tail 58 having a substantially smaller radius of curvature. This conventional vane design is characterized by having a symmetric shape relative to an axis running through the vane from the leading to the trailing edges. That is, the inner airfoil surface 52 and outer airfoil surface 54 are symmetric relative to one another, resulting in a flat or straight camberline.

Figure 5B:
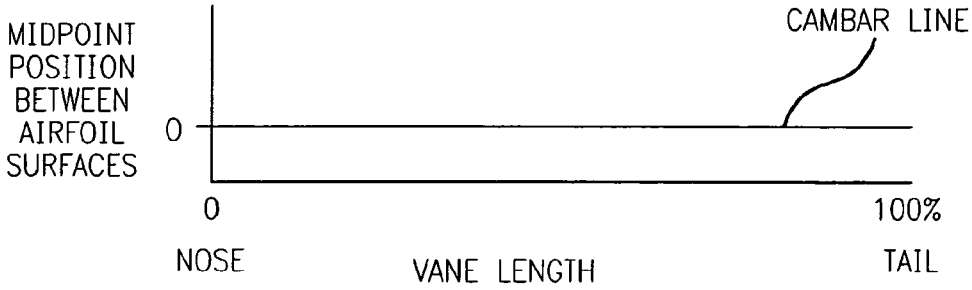
FIG. 5B PRIOR ART

The symmetric shape of this first conventional vane design is reflected in FIG. 5B that illustrates the camberline graph for the vane. The camberline of a vane, also commonly referred to as the centerline, is the line that runs through the midpoints between the vane inner and outer airfoil surfaces and between the leading and trailing vane edges. Its meaning is well understood by those skilled in the relevant technical field.

The mathematical description of the camberline is a relatively complex series of functions, however these functions are also commonly understood by those skilled in the relevant technical field. In practice, the camberline of a vane can be represented by a plot of the midpoints between the vane inner and outer airfoil surfaces at set intervals running along the length of the vane defined between the leading and trailing vane edges. The camberline can also be represented by a plot of the centers of multiple circles drawn inside the vane tangent to both the inner and outer airfoil surfaces.

As used herein, the vane length is an inherent feature of the vane and is defined as the length of the straight line that runs between the leading and trailing vane edges. For the plots contained in FIGS. 5B, 6B and 7B, the x-axis represents distance along the vane measured as a percentage of the vane length. The y-axis represents distance from an arbitrary reference line parallel to the x-axis; for sake of convenience herein, the vane leading edge and trailing edge each have a y-coordinate set at zero and the x-axis therefore runs through these two points. In the case of FIG. 5B, the camberline graph for this conventional vane design is essentially flat, showing no changes in curvature in the vane, explaining why the conventional vane is referred to as a straight vane.

The use of such straight vanes in VGTs has been shown to provide unwanted aerodynamic effects within the turbine housing. Specifically, this vane design produces an unwanted back-pressure within the turbine housing thought to be caused by a reduced rate of acceleration as the exhaust gas is passed over the vane nose and along the remaining vane surface, thereby operating to restrict the range within which this vane is capable of providing well distributed gas flow to the turbine wheel. Also, the leading edge profile of this vane design does not contribute to optimal aerodynamic efficiency. Additionally, the straight design of the inner and outer airfoil surfaces do not operate to provide a smooth aerodynamic surface when the vanes are staged together in a closed position, e.g., the transition of air as it flows over the tail of one vane and to the nose of an adjacent vane is not as aerodynamic as desirable.

Figure 6A:
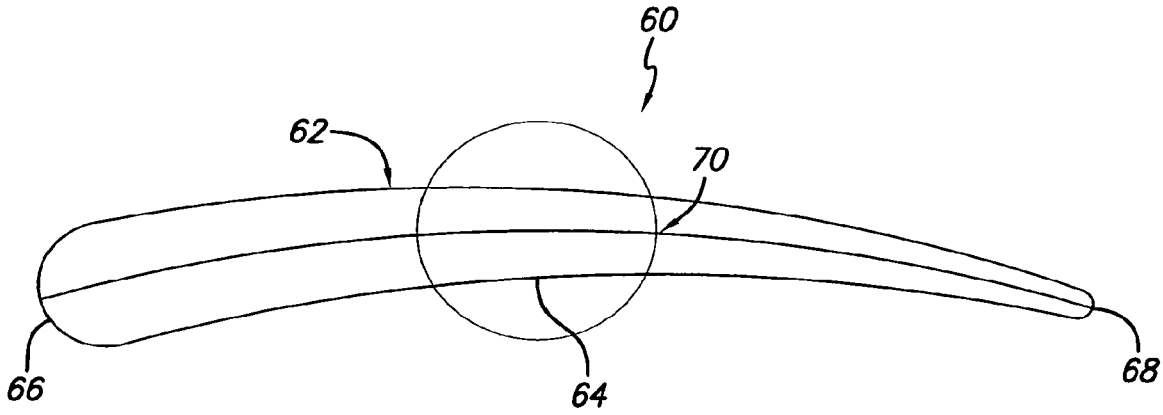
FIGS. 6A and 6B are a respective elevational side view of a first example cambered vane embodiment of this invention, and a camberline graph for the same.

FIG. 6A illustrates a first embodiment cambered vane 60 of this invention comprising an outer airfoil surface 62 that is generally convex in shape and that is defined by either a continuous curve or a composite series of curves, and an opposite inner airfoil surface 64 that is generally convex and that is defined by either a continuous curve or a composite series of curves. A leading edge 66 or nose is disposed at one end of the vane between the inner and outer airfoil surfaces, and a trailing edge 68 or nose is disposed at an opposite end of the vane between the inner and outer airfoil surfaces.

Figure 6B:
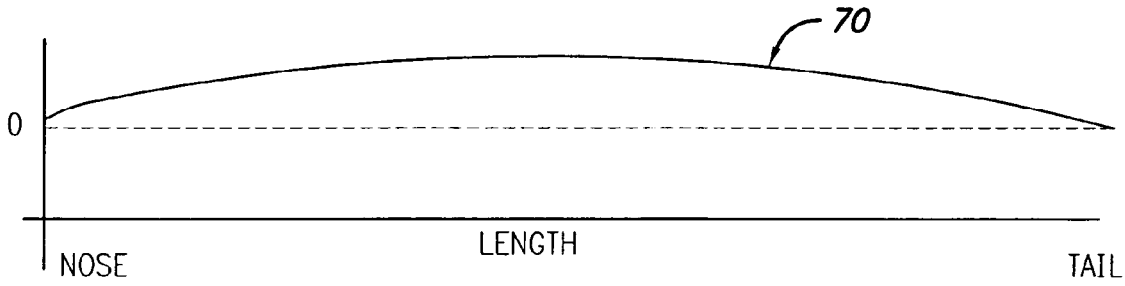

Referring now to FIGS. 6A and 6B, a key feature of cambered vanes of this invention is that they have a camberline 70, or centerline positioned between the inner and outer airfoil surfaces, that is curved and not straight along a substantial length of the camberline length. More specifically, cambered vanes of this invention have a camberline 70 characterized by a curve having a measure of curvature similar to that of a diameter defined by the placement of the vanes within the turbocharger along the turbocharger nozzle wall.

As noted above, the turbocharger comprises a number of vanes that are positioned along the turbocharger nozzle wall concentrically around the turbine wheel. The distance between the point on the vane where the vane pivots along the nozzle wall and the center of the turbine wheel is referred to as the vane pivot radius. Referring back to FIG. 3A, the diameter of circle 69 that is formed by connecting all of the vane pivot points along the nozzle wall is referred to as the vane pivot diameter. Thus, the pivot diameter for such vanes is independent of the position of the vanes, e.g., whether they are oriented in an opened or closed position, and focuses on the point of attachment of the vanes to the nozzle wall. It is desired that cambered vanes of this invention have a camberline 70 or centerline, running through the vane from the leading edge to the trailing edge and running between the airfoil surfaces, having a curved section with a measure of curvature that is very close in dimension to the vane pivot diameter, i.e., the corresponds in curvature to the vane pivot diameter.

While the concept of this invention has been disclosed and illustrated in the context of a turbocharger comprising vanes configured to pivot about the nozzle wall, it is to be understood that the general concept of this invention also applies to turbochargers having vanes that do not move or that are configured to move in a manner other than that described above. In such case, the camberline for such vanes will be very close in dimension to the placement diameter of the vanes around the turbine wheel. Generally speaking, the term vane pivot diameter is understood to be a specific type of vane placement diameter, i.e., one specific to use of pivotably attached vanes.

In an example embodiment, where the vanes are not configured to move or are configured to move in a manner different than that described above, cambered vanes of this invention having a camberline curved section with a measure of curvature defined by the vane placement diameter rather than the vane pivot diameter. The vane placement diameter in such vane embodiments can be derived by defining a first circle that is tangent to an outermost portion of the vanes, e.g., a portion of each vane's leading edge along an outer airfoil surface, as arranged around the turbine wheel, and defining a second circle positioned concentrically within the first circle and tangent to an innermost portion of the vanes, e.g., a portion of each vane's trailing edge along an inner airfoil surface. This technique applies independent of whether the vanes are oriented in an opened or closed position. The vane placement diameter for such vanes is positioned midway between the first and second circles.

In an example embodiment, cambered vanes of this invention have a camberline, the substantial length of which is defined by a curved section or arc having a measure of curvature that is within the range of from about 75 to 125 percent of the vane pivot or vane placement diameter for the particular turbocharger, more preferably in the range of from about 90 to 100 percent of the vane pivot or vane placement diameter, and most preferably 100 percent of the vane pivot or placement diameter.

As used above, the term "substantial" is used to account for the fact that the camberline for a particular vane of this invention may include one or more curved sections that are not characterized by the desired pivot or placement diameter, e.g., reflecting segments of one or both airfoil surfaces that may not be symmetric with one another or not have a curved shape defined by a single radius of curvature. In such case, however, it is understood that a substantial portion or majority of the camberline curved section will have a measure of curvature within the desired range of the vane pivot or placement diameter.

Cambered vanes having a camberline curved section with a measure of curvature that is less than about 75 percent of the vane pivot or placement diameter is not generally desired because it may generate a high level of swirl within the turbine housing upstream of the turbine, producing a high friction loss. This can reduce the amount of energy delivered to the turbine, thereby reducing turbocharger efficiency. Cambered vanes having a camberline curved section with a measure of curvature that is greater than about 125 percent of the vane pivot or placement diameter may not generally be desired because it can generate too little swirl within the turbine housing, making vane performance very much like a prior art straight vane.

The cambered vane 60 has a leading edge 66 or nose, and a trailing edge 68 or tail that are each defined by respective radiused surfaces, wherein the leading edge is defined by a radius of curvature that is generally larger than that of the trailing edge. The cambered vane 60 also has a variable vane thickness that is defined between the outer and inner airfoil surfaces 62 and 64. Specifically, the cambered vane of this particular embodiment has a progressively decreasing thickness moving from the leading edge 66 to the trailing edge 68.

In an example embodiment, the above-described cambered vane has a camberline that is defined by a vane pivot diameter of approximately 59 mm and a vane length (as measured by a straight line running between the vane leading and trailing edges) of 18 mm.

Figure 7A:
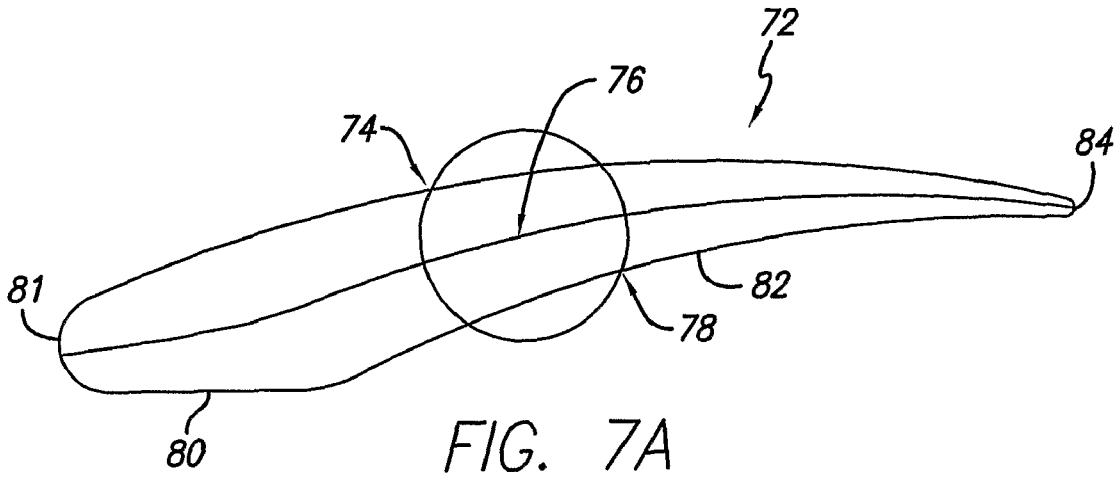
FIGS. 7A and 7B are a respective elevational side view of a second example cambered vane embodiment of this invention, and a camberline graph for the same.

FIG. 7A illustrates another cambered vane 72 of this invention that is somewhat similar to that described above and illustrated in FIG. 6, in that it also includes a generally concave outer airfoil surface 74, and that it also has a camberline 76 or centerline running through the vane that bears a defined relationship to the vane pivot diameter. However, in this particular embodiment, the inner airfoil surface 78 comprises a composite of two differently configured sections; namely, a first section 80 extending a distance from the leading edge 81 and that is shaped having a flat or planar profile, and a second section 82 extending from the first section to the trailing edge and having a concave shaped profile.

Figure 7B:
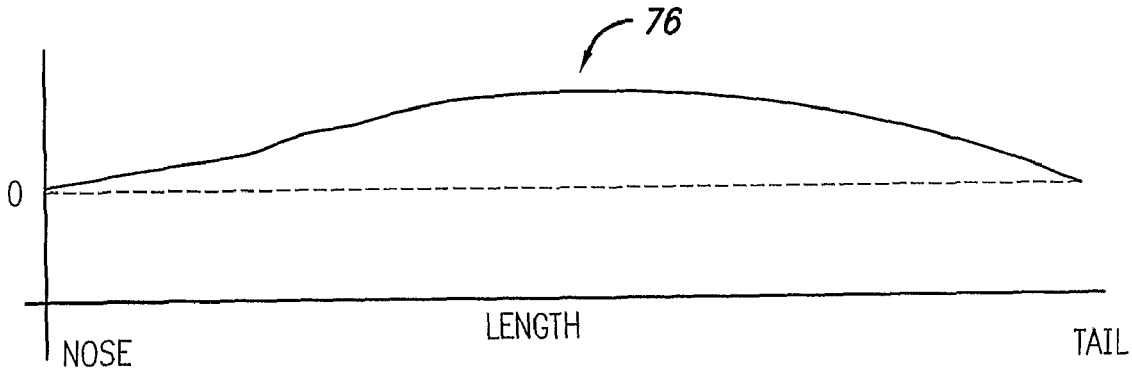

Referring now to FIG. 7B, although this particular vane embodiment comprises a composite inner airfoil surface having a planar introductory section 80, a substantial length of the camberline running though the vane still is still characterized by a curve that is defined within the above-noted ranges by the vane pivot diameter.

In this cambered vane embodiment, the planar introductory portion of the inner airfoil surface is provided for the purpose of helping to direct exhaust gas towards the turbine wheel, thereby operating to increase the aerodynamic efficiency of gas flow over the vane and to the turbine wheel. More specifically, this particular inner airfoil surface configuration operates to promote the efficient flow of exhaust gas into the throat of the turbine housing upon the initial opening range of the vane from a closed position.

While this cambered vane embodiment is illustrated as having a planer introductory inner airfoil surface, it is to be understood that this section of the inner airfoil surface can be shaped differently to provide similar desired vane aerodynamic effects. For example, the introductory inner airfoil surface can comprise a slightly concave or convex surface feature in addition to or in place of the planar surface feature to provide similar aerodynamic results.

In an example embodiment, it is desired that the inner airfoil surface introductory portion or first section 80 occupy no more than about 35 percent of the total vane length. In a preferred embodiment, the airfoil surface first section 80 occupies approximately 25 percent of the total vane length as measured from the leading edge 81. A cambered vane having an inner airfoil surface first section that occupies greater than about 35 percent of the total vane length may not be desired because, when the vanes are arranged on the nozzle ring, having too large a flat section can result in having to use a greater number of vanes than otherwise necessary to provide a closed vane assembly. Using more vanes than otherwise necessary is not desired because each additional vane that is used increases the mechanical complexity of proper vane operation, increases the amount of unwanted aerodynamic friction occurring within the turbine housing, and/or increases cost.

In an example embodiment, the above second described cambered vane has a camberline that is defined by a vane pivot diameter of approximately 59 mm, a vane length (as measured by a straight line running between the vane leading and trailing edges) of approximately 22 mm, and an inner airfoil surface introductory portion or first section of approximately 5 mm.

Cambered vanes of this invention are specifically designed for the purpose of providing improved aerodynamic efficiency associated with the passage of exhaust gas within the turbine housing to the turbine wheel. The vane outer and inner airfoil surfaces are configured to provide a vane camberline or centerline that is curved and defined within a desired degree of tolerance by the vane pivot diameter. Configured in this manner, cambered vanes of this invention operate to increase the range of well-distributed gas flow within the turbine housing, thereby operating to increase the effective operating window of the turbocharger.

Cambered vanes of this invention can be formed from the same types of materials, and in the same manner, e.g., molded, folded or machined, as that used to form conventional prior art vanes. The cambered vanes of this invention can have a substantially solid design or can be configured having a hollow or cored out design, depending on the particular application. In an example embodiment, the improved vanes of this invention are configured having solid axial surfaces.

Having now described the invention in detail as required by the patent statutes, those skilled in the art will recognize modifications and substitutions to the specific embodiments disclosed herein. Such modifications are within the scope and intent of the present invention.

What is claimed is:

1. A cambered vane for use in a variable geometry turbocharger comprising:

an inner airfoil surface;

an outer airfoil surface oriented opposite the inner airfoil surface, the inner and outer airfoil surfaces defining a vane airfoil thickness;

a leading edge positioned along a first inner and outer airfoil surface junction; and a trailing edge positioned along a second inner and outer airfoil surface junction;

wherein the vanes are positioned concentrically around a turbine wheel in the turbocharger, the inner airfoil and outer airfoil surfaces define a camberline positioned therebetween that extends from the leading edge to the trailing edge, and wherein the camberline includes a curved section along a substantial length of the vane between the leading and tailing edges, the curved section having a measure of curvature that is within 75 to 125 percent of a vane placement diameter defined by the concentric placement of vanes around the turbine wheel and wherein the outer airfoil surface comprises a continuous convex shape and the inner airfoil surface includes a planar section adjacent the vane leading edge.

2. The vane as recited in claim 1 wherein the vane camberline curved section measure of curvature is within 90 to 110 percent of the vane placement diameter.

3. The vane as recited in claim 1 wherein the outer airfoil surface comprises a continuous convex-shape, and the inner airfoil surface comprises a continuous concave shape.

4. The vane as recited in claim 1 wherein the planar section comprises no more than about 35 percent of the total vane length as measured by a straight line taken between the vane leading and trailing edges.

5. A turbocharger assembly comprising:

a turbine housing having an exhaust gas inlet and an exhaust outlet, and a volute connected to the inlet;

a turbine wheel carried within the turbine housing and attached to a shaft;

a plurality of vanes pivotably disposed within the turbine housing between the exhaust gas inlet and turbine wheel, each vane comprising:

an inner airfoil surface oriented adjacent the turbine wheel;

an outer airfoil surface oriented opposite the inner airfoil surface, the inner and outer airfoil surfaces defining an airfoil thickness;

a leading edge positioned along a first inner and outer airfoil surface junction;

a trailing edge positioned along a second inner and outer airfoil surface junction;

wherein the inner and outer airfoil surfaces define a vane camberline extending along a vane length extending between the leading and trailing edges, wherein the vane camberline includes a curved section along a substantial length thereof having a measure of curvature that is within 75 to 125 percent of a vane placement diameter as defined between diametrically opposed vanes and wherein the outer airfoil surface comprises a continuous convex shape and the inner airfoil surface includes a planar section adjacent the vane leading edge.

6. The turbocharger assembly as recited in claim 5 wherein the vane camberline curved section measure of curvature is within 90 to 110 percent of the vane placement diameter.

7. The turbocharger assembly as recited in claim 5 wherein the outer airfoil surface comprises a continuous convex-shape, and the inner airfoil surface comprises a continuous concave shape.

8. The turbocharger assembly as recited in claim 5 wherein the planar section comprises no more than about 35 percent of the total vane length as measured by a straight line connecting the vane leading and trailing edges.

9. A method for making an aerodynamic vane for use within a turbocharger, the aerodynamic vane comprising a length defined between vane leading and trailing ends, and a thickness defined between vane outer and inner airfoil surfaces, the method comprising the steps of:

determining the placement position of a number of aerodynamic vanes concentrically around a turbine wheel disposed within a turbocharger, such placement position defining a placement diameter around the turbine wheel; and configuring a vane outer airfoil surface and a vane inner airfoil surface such that a substantial portion of a camberline positioned between the outer and inner airfoil surfaces and running between the leading and trailing edges has a measure of curvature that is within 75 to 125 percent of the placement diameter wherein the vane outer airfoil surface comprises a continuous convex shape and the vane inner airfoil surface includes a planar section adjacent the vane leading edge.

10. The method as recited in claim 9 wherein during the step of configuring, the camberline curved to have a measure of curvature within 90 to 110 percent of the placement diameter.

11. The method as recited in claim 9 wherein the vanes are pivotably attached to the turbocharger by posts and the diameter corresponds to the placement position of the posts in the turbocharger.

* * * * *